US005078379A

United States Patent [19]

Leisner

[11] Patent Number: 5,078,379

[45] Date of Patent: Jan. 7, 1992

[54] DOCUMENT SET END DETECTION

[75] Inventor: Martin A. Leisner, Rochester, N.Y.

[73] Assignee: Xerox Corporation, Stamford, Conn.

[21] Appl. No.: 717,188

[22] Filed: Jun. 18, 1991

Related U.S. Application Data

[63] Continuation of Ser. No. 526,203, May 21, 1990, abandoned.

[51] Int. Cl.[5] ..... B65H 5/22

[52] U.S. Cl. ..... 271/3.1; 271/259; 355/320

[58] Field of Search ..... 271/3, 3.1, 4–5, 271/31, 35, 38, 98–99, 165, 265, 259; 355/320

[56] References Cited

U.S. PATENT DOCUMENTS

| | | | |
|---|---|---|---|
| 4,076,408 | 2/1978 | Reid et al. | 355/14 |
| 4,099,860 | 7/1978 | Connin | 355/14 |
| 4,269,406 | 5/1981 | Hamlin | 271/3.1 |
| 4,391,504 | 7/1983 | Acquaviva | 271/3.1 |
| 4,508,447 | 4/1985 | Doery | 271/3.1 |
| 4,568,172 | 2/1986 | Acquaviva | 272/3.1 |
| 4,579,444 | 4/1986 | Pinckney et al. | 355/14 |
| 4,589,645 | 5/1986 | Tracy | 271/3.1 |

OTHER PUBLICATIONS

Xerox Disclosure Journal, vol. 12, No. 2, Mar./Apr. 1987.

*Primary Examiner*—H. Grant Skaggs

[57] ABSTRACT

A system for detecting and signaling the feeding of a complete set, stack or job of document sheets, especially for a recirculating type automatic document feeder for a copier or other document imaging system with a document restacking tray, in which normally an electromechanical sheet separator provides an end of set detection signal by mechanically operating each time the last sheet of the stack is fed. Here, the end of set detection and control signal is provided instead by a preset brief electrical signal from a non-mechanical optical no-sheet-present-in-tray detector for those documents sets having a sufficiently small number of document sheets such that all of the document sheets are temporarily in the document recirculation path after the last sheet of the set is fed out of the document tray on each circulation so that this optical sheet presence detector briefly signals that no document sheet is present in the tray, indicative that the last sheet of the small set was fed. This same preset maximum time period signal is used to automatically deactivate the regular electromechanical end of set detector for all further set circulations of that job to reduce wear and jam or set circulation miscount risks.

6 Claims, 4 Drawing Sheets

DOCUMENT SET END DETECTION

Figure 1:
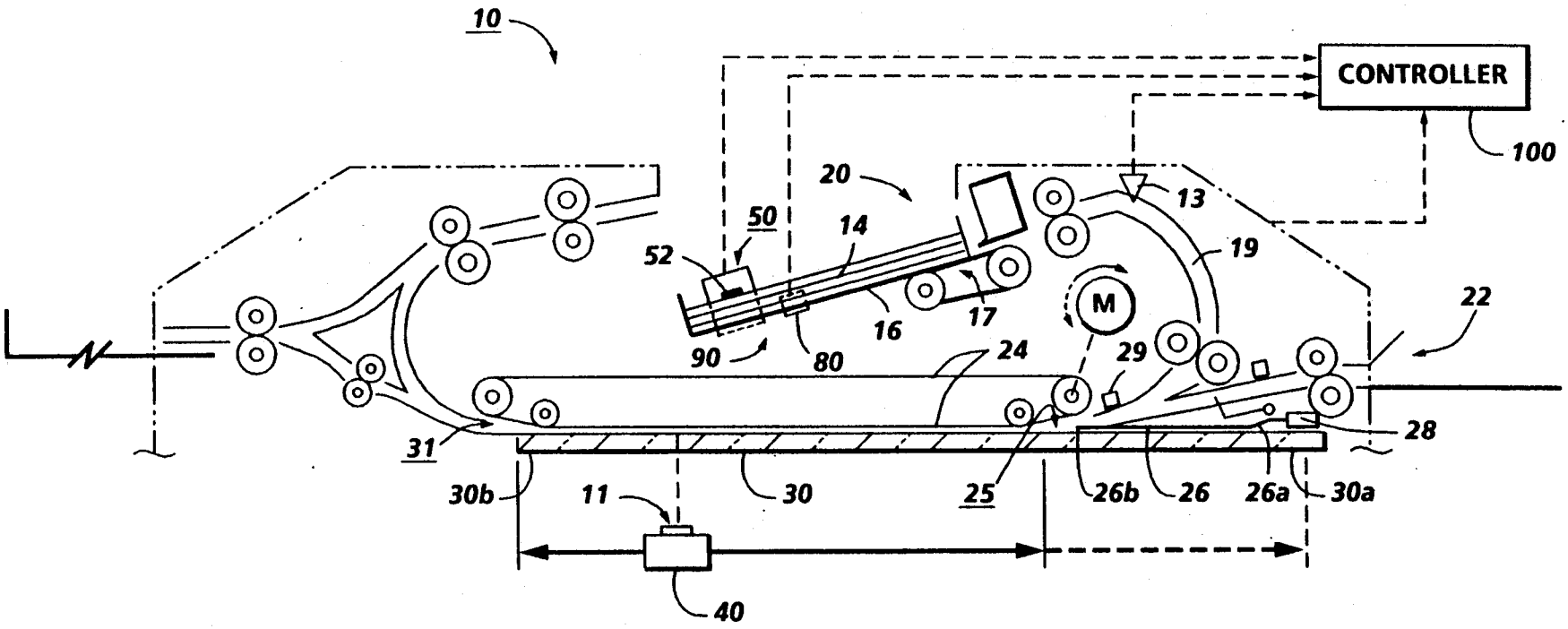

This is a continuation of application Ser. No. 07/526,203, filed May 21, 1990, now abandoned.

Cross-reference is made to a copending application of the same assignee, filed July 2, 1990 as U.S. application Ser. No. 07/546,984 now allowed as U.S. Pat. No. 5,026,044, and entitled "Dual Mode Document Registration System", disclosing the same basic exemplary document handling and electronic platen scanning system also disclosed herein.

The present invention relates to an improved system for detecting and signaling the feeding of a set or job of document sheets for imaging, especially for a recirculating type document handler for a copier or other document imaging system.

There is disclosed herein an improved control system for a copier or other document imaging system with an automatic document feeder in which, for small document sets, it has been found that a predetermindly brief signal from the conventional electronic document presence sensor in the document feeder tray is indicative of an end of set or last sheet feeding prior to restacking of the first fed document sheet and that this signal may be used to provide an end of set feeding signal in lieu of the conventional electromechanically actuated set separator normally used to provide an end of set feeding signal in each case, as described herein.

Depending on the overall recirculating type document handler document circulation path length, this disclosed system may be used for small document set jobs of up to four document sheets. These small document sets are all very common sizes of copying or imaging jobs, normally involving rapid and frequent operation of the electromechanical set separator, and thus high wear and increased risk of jams and machine shutdowns. The present system allows the operation of the electromechanical set separator to be suspended in such small job situations yet still provide reliable end of set signals therefore, which may be combined with the document sheet feeding counter in the normal manner to determine the number of document sheets in the document set being fed and provide various control functions. This system can reduce wear, jam or set circulation miscount risks in comparison to the normal operation of the electromechanical set separator. In the hereinbelow disclosed system example, the end of set detection and control signal is provided instead by a preset brief electrical signal from a non-mechanical optical no-sheet-present-in-tray detector for those documents sets having a sufficiently small number of document sheets such that all of the document sheets are temporarily in the document recirculation path after the last sheet of the set is fed out of the document tray on each circulation so that this optical sheet presence detector briefly signals that no document sheet is present in the tray, indicative that the last sheet of the small set was fed. This same preset maximum time period signal is used to automatically deactivate the regular electromechanical end of set detector for all further set circulations of that job.

As to the disclosed exemplary recirculating document handler (RDH) or document feeder, per se, it may desirably, with only minor control function modifications as described herein, be of a desirable known type. Such RDH's are well known for use with conventional optical light-lens copiers, although shown here with an electronic document scanner imaging system, as noted below.

By way of background, disclosed herein by way of such example of an RDH is a well known dual input type RDH, an RDH/SADH. RDH/SADH is a common abbreviation for a well known type of document handler with a top tray document loading recirculating document handler (RDH) mode and an integral alternative side document entrance or SADH slot providing a semi-automatic document handler (SADH) unidirectional document input. This disclosed RDH system allows documents to be automatically or semi-automatically fed onto an imaging platen from either infeeding position. Examples of patents thereon are cited below. However, this is merely exemplary, and the present invention is not limited to any particular type of recirculating or common tray restacking document handler or document feeder.

Although of particular utility as part of a conventional optical (non electronic imaging) precollation copier with a multiply recirculating document handler, as additionally disclosed herein, the disclosed system may also be desirably used in a system for feeding a set of documents for electronic imaging.

In a document feeder for an electronic document imaging and printing system, a set of documents normally need only be fed to be imaged once, and electronically stored, to make any number of ultimate printed copies. Yet even there a known recirculating document handler (RDH) such as cited herein can be desirable for feeding duplex (two-sided) documents, to recirculate the document set twice, with inversion during the first circulation, to copy both sides of the documents more rapidly or efficiently, by imaging all of the even page sides, and then all of the odd page sides, versus a document handler which must invert and image both sides of each document in direct sequence one at a time.

An example of such an electronic document imaging and printing system is disclosed in Xerox Corporation U.S. Pat. No. 4,757,348 issued July 12, 1988, to Rourke, et al and commonly filed U.S. Pat. No. 4,716,438 issued Dec. 29, 1987, that is compatibly usable with the present system, if desired. Among many other examples of platen scanning electronic imaging systems per se are Xerox Corporation U.S. Pat. No. 4,295,167 or related U.S. Pat. No. 4,287,536. The terms copying and imaging are used interchangeably in this particular case.

Also as to specific hardware components of the subject apparatus, it will be appreciated that, as is normally the case, various such specific hardware components are known per se in other apparatus or applications, including that described in art cited herein, and need not be re-described herein. Particularly noted re the disclosed RDH document handling system is Xerox Corporation U.S. Pat. No. 4,579,444, issued Apr. 1, 1986, to Pinkney and Sanchez, and/or other RDH art cited therein. Said U.S. Pat. No. 4,579,444 is of appropriate background interest as illustrating the general nature of the specific embodiment of the disclosed document handler and platen. Some other examples of prior art recirculating document handlers are disclosed in U.S. Pat. Nos. 4,278,344 issued July 14, 1981, to R. B. Sahay; 4,270,746 issued June 2, 1981, to T. J. Hamlin, and 4,076,408 issued Feb. 28, 1978, to M. G. Reid, et al. Also, in U.S. Pat. Nos. 4,176,945; 4,330,197, 4,466,733; and 4,428,667.

Of particular interest, said U.S. Pat. No. 4,076,408 issued Feb. 28, 1978, to M. G. Reid, et al. also includes a separate optical emitter/detector 149, 151 in the document tray to detect the presence (loading) or absence of any documents in the tray. A similar disclosure is in U.S. Pat. No. 4,099,860 issued July 11, 1978, to J. L. Connin. More typically, such document tray document presence sensors are a conventional integral corner bottom light beam sensor unit, in which a light transmitter on the registration side wall slightly above the tray bottom transmits a light beam downwardly at an angle into an adjacent receiver or sensor in the tray bottom, and this light beam is occluded by any (even one) document sheet in the tray lying on the tray bottom. However, heretofore this information was merely used to tell the copier controller that the RDH tray mode of operation was in use, or, in clearing a jam, that there was a document to be removed and the reloaded with others in the document tray.

By way of further background, various conventional optical light beam document sensors per se are shown in U.S. Pat. Nos. 3,689,143, 4,281,919, 4,344,703, 4,366,219, 4,338,020, 4,540,887, 4,456,372, 4,568,181 4,585,332, or 4,391,505 or Xerox Disclosure Journals Vol. 11 No. 1, p. 33, February 1986, or Vol. 12 No. 5, p. 239–40, October 1987; or, in a moving platen system, by reflection of document illumination lamp light, as in U.S. Pat. Nos. 4,357,095, 4,505,574, or 4,659,214. The present system should be distinguished from such various prior art systems for merely attempting to detect the presence or absence or position or size of a document, per se.

These RDH patents also discuss the significance of a recirculating document handler in providing for precollation copying to make any desired plural number of precollated copy set of the document set loaded (stacked) into the RDH input tray, by plurally recirculating the documents from the RDH tray to the platen (to make one or two copies per circulation) and back to this same tray. Preferably this is accomplished by sequentially continuously feeding the document sheets out from the bottom of the stack and returning them to restack on the top of the stack in the RDH tray.

However, effective precollation RDH copying requires knowing when one complete circulation of the document set or stack by the RDH has ended, before the next document set circulation. Heretofore that has normally been done by a "set separator", a device with an arm that is set on top of the documents and drops to actuate a switch when the last sheet of the set is fed out from under the arm, as described for example in Xerox Corporation U.S. Pat. No. 4,589,645 issued May 20, 1986, to M. J. Tracy, and art cited therein. That U.S. Pat. No. 4,589,645 set separator disclosure is partially included herein.

As indicated in said U.S. Pat. No. 4,589,645 set separator disclosure, and in U.S. Pat. No. 4,469,320 issued Sept. 4, 1984, to S. J. Wenthe, and in the "Xerox Disclosure Journal" publication Vol. 6, No. 4, July/August 1981, p. 167, in automatic recirculating document handlers, a document set separating finger or bail bar system is used to separate or distinguish those document sheets to be fed from those which have been returned to the document tray following the copying operation. A finger or bail normally lightly rests on the document stack and moves down with gravity as the sheets are fed out from under the finger. When the finger is no longer over any documents it drops to activate a switch which signifies that all the documents have been copied. The finger or bail is then automatically reset to the top of the stack to initiate another feed cycle, by a solenoid or other drive mechanism which pulls the finger back and then lifts it up to the reset position.

As noted, an important feature of the above-noted and other set separator systems is reliably detecting the feeding of all the sheets in the set from the stack support or tray area. Set separators are also known in the art as set counters or bail bars. This is needed to tell the system each time the complete document set is circulated, i.e. to keep track of the number of set circulations.

The set separator end of set signal is typically coupled through the copier logic system to another sensor or counter which counted the number of sheets that were fed. With the combination of these two inputs or signals the precise number of document sheets in the document set can be readily determined after the first circulation. See, e.g., by way of further background, U.S. Pat. No. 4,278,344 issued July 14, 1981, to R. B. Sahay and the references cited therein. It is also known that this actual set count information can be used to set, or reset, the pneumatic air knife or other document feeder parameters, as noted above.

Such set separators may also be utilized in sheet feeding applications other than RDH systems. For example, they may be used in a duplex buffer tray for copy sheets being duplexed, as taught in U.K. published application G.B. 2,058,023A. I.e. for keeping track of and separating duplex copy sheet sets being made in an automatic duplex (2 sided) copier. The system disclosed herein may also be utilized in such other applications.

By employing or incorporating a stack height sensor as a part of the set separator system, as indicated in said incorporated U.S. Pat. No. 4,589,645, the reset position of the finger on the top of the stack can be utilized to give an indication of the stack height for automatically adjusting vacuum, air, or normal force pressures in the document feeder, to compensate for the weight or height of the stack. Variations in the stack height variably reposition the finger relative to a sensor. More than one sensor can be provided for the various potential reset positions of the finger. The importance, applications and problems relating to such systems are also discussed in U.S. Pat. No. 4,469,320 issued Sept. 4, 1984, to S. J. Wenthe.

However, such electromechanical set separators are prone to mechanical failures (by arm dropping failures or arm lifting and resetting failures, or by jams by curled sheets, or the like), with undesirable consequences, as noted for example in the Xerox Disclosure Journal publication Vol. 12, No. 2, March/April 1987 at page 155. That publication also describes shutdown protection at a preset maximum allowed document count from such set separator failure.

Although this document set separator art is well developed, as shown by the number of references cited above and below, the very number of different designs which have been utilized is indicative of reliability and other problems associated therewith.

The following additional exemplary art is noted on set separator or bail bar systems per se, listed in numerical order: U.S. Pat. Nos.: 3,556,513 issued Jan. 19, 1971, to A. Howard (Xerox); 3,815,896 issued June 11, 1974, to A. Hoyer (Xerox) (note especially FIGS. *7a–7c*); 3,861,671 issued Jan. 21, 1975, to A. Hoyer (Xerox); 3,895,790 issued July 22, 1975, to A. Hoyer et al. (Xerox); 3,941,376 issued Mar. 2, 1976, to K. Liechty, et al. (Xerox); 3,954,259 issued May 4, 1976, to D. Gerbasi (Xerox); 4,078,787 issued Mar. 14, 1978, to Berlew et al.

(Eastman Kodak) (note Ref. Nos. 90, 91, 92, 125 and Col. 8, second paragraph, Col. 10, Paragraph No. 5 and Col. 11, first paragraph); 4,116,558 issued Sept. 26, 1978, to J. Adamek et al. (Xerox) (note item 61, 61*a*, 61*b*); 4,164,347 issued Aug. 14, 1979, to T. McGrain (Eastman Kodak); 4,231,561 issued Nov. 4, 1980, to T. Kaneko et al (Ricoh) (note e.g. Col. 11, lines 35–46); 4,231,562 issued Nov. 4, 1980, to T. Hori (Savin); 4,433,836 issued Feb. 28, 1984 to W. J. Kulpa et al (Pitney Bowes); 4,451,138, issued May 29, 1984, to C. P. Anderson (Ricoh); U.K. Patent Application GB 2,058,023A published Apr. 8, 1981, (Xerox); German OLS 2232023 laid open Jan. 17, 1974, by Licentia Patent-Verwaltungs GMBH; U.S.P.T.O. Defensive Publication No. T964,008 published Nov. 1, 1977, by W. E. Hunt (Eastman Kodak); the U.K. "Research Disclosure" Journal Publications Nos. 15842 of June 1977, and 20433 of April 1981; and the "Xerox Disclosure Journal", Vol. 5, No. 4 July/Aug 1980, p. 375, Vol. 5, No. 6, Nov/Dec 1980, pp. 625–6, and Vol. 8, No. 3, May/June 1983, pp. 189–190.

Other patent references particularly noted as of collateral background interest to the subject system include U.S. Pat. No. 3,284,080; 4,285,508; 4,637,598; 4,629,311; and 4,480,824. As disclosed, inter alia, U.S. Pat. No. 3,284,080 describes a document feeder with a sensor and control system operative after a predetermined time interval, U.S. Pat. No. 4,285,508 shows plural optical sheet sensors, U.S. Pat. No. 4,637,598 is of particular interest as showing an integral, optically reflective, set separator and sheet optical presence sensor in a document feeder tray, U.S. Pat. No. 4,629,311 also has a sheet optical presence sensor in a recirculating document feeder tray, and U.S. Pat. No. 4,480,824 is of particular interest as showing a document sheet optical sensor and associated time delayed jam (mis-stacking) control in a recirculating document feeder tray.

As noted in the prior art, as xerographic and other copiers increase in speed, and become more automatic, it is increasingly important to provide higher speed yet more reliable and more automatic handling of the plural document sheets being copied, i.e. the input to the copier.

A preferred type of copier document handling system is one that can utilize an existing or generally conventional copier optical imaging system. That is, utilizing the external transparent copying window (known as the platen or imaging station) of the copier. Preferably in document handling systems the document is automatically registered for copying overlying a selected portion of full-sized (full-frame) platen which is at least as large as the largest document to be normally copied. In such systems the document is preferably either scanned or flashed while it is held stationary on the platen in the desired registration position.

In the description herein the term "document" or "sheet" refers to a usually flimsy sheet of paper, plastic, or other such conventional individual image substrate, and not to microfilm or electronic images which are generally much easier to manipulate. The "document" is the sheet (original or previous copy) being imaged, or copied in the copier onto the "copy sheet", which may be abbreviated as the "copy". Plural sheets of documents being imaged as a group in some desired related arrangement, even if not in an actual page order, or their copies, are referred to as a "set". A "duplex" document is a sheet desired to be copied on both sides, as opposed to a "simplex" or single side imaged document.

A specific feature of the specific embodiment disclosed herein is to provide a sheet feeding system with a sheet stacking and feeding tray in which a set of sheets may be stacked to be sequentially fed from said tray for processing and returned in a sheet circulation path back to said tray to be restacked in said same tray, said tray having a non-mechanical optical sheet presence detector for detecting the presence of any sheet in said tray, and said tray having an electromechanical sheet separator system normally providing an end of set detection control signal by being mechanically operated when the last sheet of said set of sheets is fed from said tray; the improvement wherein, for a said set of sheets having a sufficiently small number of sheets that all of the sheets of that small set are in said sheet circulation path after the last sheet of that small set is fed out of the document tray, so that briefly said optical sheet presence detector signals that no sheet is present in said tray, then said end of set detection control signal is automatically provided by said brief signal from said optical sheet presence detector rather than from said electromechanical sheet separator system and said mechanical operation of said electromechanical sheet separator system when the last sheet of a set of sheets is fed from said tray is automatically disabled for subsequent feedings of said same small set of sheets from said tray.

Further specific features provided by the system disclosed herein, individually or in combination, include those wherein The sheet feeding system of claim 1, wherein said set of sheets having a sufficiently small number of sheets is a set of four or less sheets, said set of sheets having a sufficiently small number of sheets is a set of one to three sheets and/or wherein, when said set of sheets is a set of four or less sheets, said electromechanical sheet separator system is only mechanically operated once, after said set of sheets is stacked in said tray, for only the initial feeding of said set of sheets from said tray, and/or wherein said sheet feeding system is a recirculating document handler and said set of sheets are a set of documents being plurally recirculated in said sheet circulation path for imaging, and/or wherein said sheet feeding system is a recirculating document handler and said set of sheets are a set of documents being plurally recirculated in said sheet circulation path for imaging, and/or wherein said end of set detection control signal is automatically provided by said brief signal from said optical sheet presence detector rather than from said electromechanical sheet separator system only for a said brief signal of less than two seconds in time duration, and wherein said sheet feeding system is a recirculating document handler and said small set of sheets is a set of four or less documents being plurally recirculated in said sheet circulation path for imaging.

The disclosed apparatus may be readily operated and controlled in a conventional manner with conventional control systems. Some additional examples of control systems for various prior art copiers with document handlers, including sheet detecting switches, sensors, etc., are disclosed in U.S. Pat. Nos. 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in general, and preferable, to program and execute such control functions and logic with conventional software instructions for conventional microprocessors. This is taught by the above and other patents and various commercial copiers. Such software will of course vary depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively be provided utilizing various other known or suitable hard-wired logic or switching systems. As shown in the above-cited art, the control of exemplary document and copy sheet handling systems in copiers may be accomplished by conventionally actuating them by signals from the copier controller directly or indirectly in response to simple programmed commands and from selected actuation or non-actuation of conventional copier switch inputs by the copier operator, such as switches selecting the number of copies to be made in that run, selecting simplex or duplex copying, selecting whether the documents are simplex or duplex, selecting a copy sheet supply tray, etc. The resultant controller signals may conventionally actuate various conventional electrical solenoid or cam-controlled sheet deflector fingers, motors or clutches in the copier in the selected steps or sequences as programmed. Conventional sheet path sensors, switches and bail bars, connected to the controller, may be utilized for sensing and timing the positions of documents and copy sheets, as is well known in the art, and taught in the above and other patents and products. Known copying systems utilize such conventional microprocessor control circuitry with such connecting switches and sensors for counting and comparing the numbers of document and copy sheets as they are fed and circulated, keeping track of their positions, counting the number of completed document set circulations and completed copies, etc., and thereby controlling the operation of the document and copy sheet feeders and inverters, etc..

All references cited in this specification, and their references, are incorporated by reference herein where appropriate for appropriate teachings of additional or alternative details, features, and/or technical background.

Figure 2:
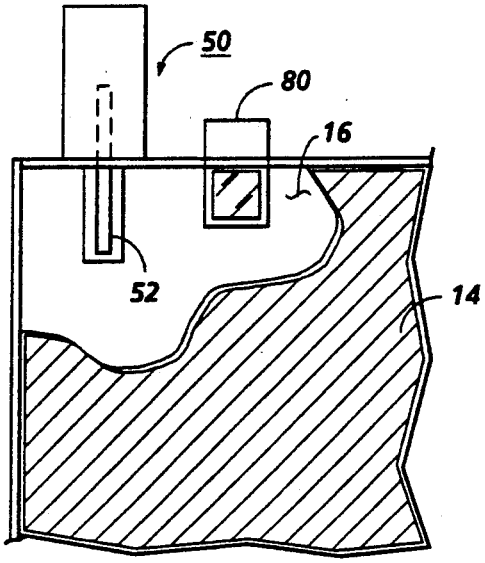
Figure 3:
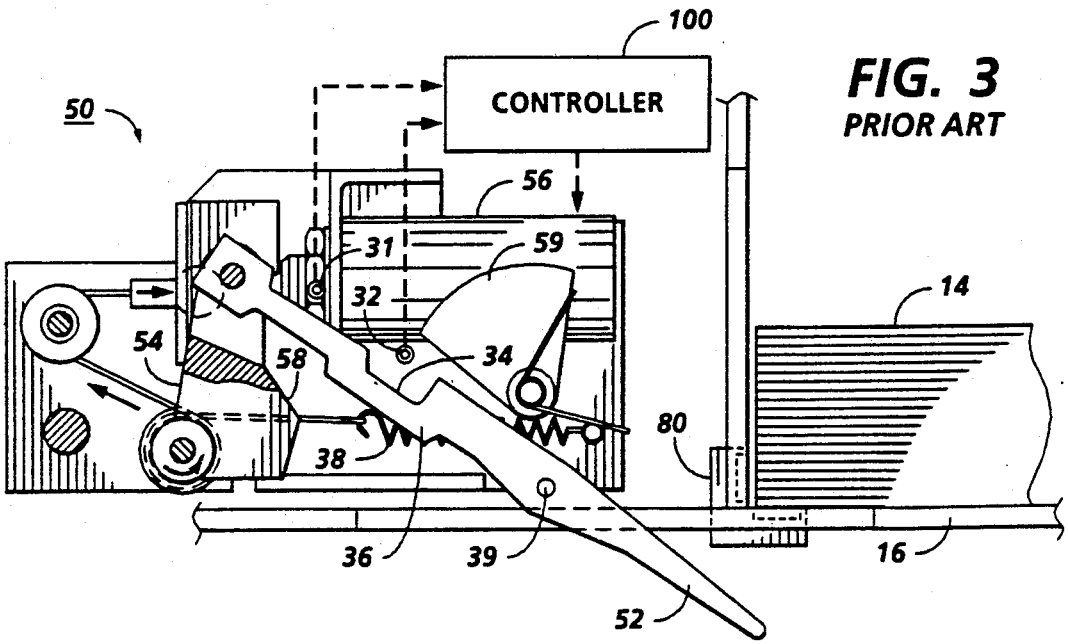
FIG. 3 PRIOR ART

Various of the above-mentioned and further features and advantages will be apparent from the specific apparatus and its operation described in the example below, as well as the claims. Thus the present invention will be better understood from this description of an embodiment thereof, including the drawing FIGURES (approximately to scale), wherein:

FIG. 1 is a schematic side view of one embodiment of the system of the invention, showing an exemplary RDH document handler with an exemplary end of document set control system therefor;

FIG. 2 is an enlarged partial schematic top view of one portion of the embodiment of FIG. 1; and FIGS. 3–7 are views of the prior art exemplary disclosed set separator per se of the embodiment of FIGS. 1 and 2, taken from the above-cited U.S. Pat. No. 4,589,645 drawings, in which FIGS. 4–7 are partial (simplified) front views of the prior art set separator embodiment of FIG. 3, showing different positions of the operation thereof.

Describing now in further detail the exemplary embodiment with reference to the FIGURES, this disclosed document end of set detection and control system 90 is shown in FIGS. 1 and 2 as a part of an exemplary integral document handling and imaging or copying system 10 with a recirculating document handler 20 shown by way of one example of a document handler for use with and/or control by the subject document detection and control system.

The RDH 20 may be conventional and may be mounted to, as a part of, any conventional copier. Furthermore, the present system is applicable to numerous other sheet feeding systems, of which this is merely one example. Further details are described in the above-cited and other references, and need not be repeated herein. This otherwise conventional recirculating document sheet handler 20 may be used for precollation copying, in which a stack 14 of individual flimsy document sheets are loaded into the generally horizontal and planar bottom surface of a restacking tray 16 to be fed seriatim from the bottom of the stack 14 by a vacuum belt or other individual sheet output feeder 17, assisted by an air knife, as shown, both of which are adjacent the front or downstream edge of the stack 14. Each sheet, after it has been fed out to the copier platen and copied, is returned via a restacking feeder or transport which feeds the returning sheet in over the top of the stack 14 from the rear of the stack and releases the sheet to restack by settling down on top of the stack between aligning edge guides. Thus, the document sheets can be continuously recirculated, in the same order, as often as desired.

The disclosed dual mode document registration document handler 20, which has a special, different, mode of operation for large documents, e.g., 11"×17" or A3 documents. However, this is merely exemplary, and the present invention is not limited to any particular type of document handler or document feeder. In this particular document handler or feeder 20 large documents are preferably fed into the alternative side entrance or SADH slot 22 of the document handler 20, as compared to normal size documents which may be inserted either there or in the top of RDH stacking tray 21.

The illustrated exemplary document handler 20 is an dual input RDH/SADH unit very much like that shown in the above-cited Xerox U.S. Pat. No. 4,579,444, issued Apr. 1, 1986, although FIG. 1 there is a reversed, mirror image, or rear view a compared to FIG. 1 here. Thus, this RDH/SADH 20, including its exemplary side or SADH entrance 22, may be basically as described in that patent, except as to the novel aspects described herein. Likewise, the RDH/SADH 20 and its drives and sensors are generally conventionally connected to and controlled by a conventional programmable controller 100, programmed as further described herein.

Normally, as described in the cited and other art, a set or stack 14 of normal sized documents is placed in the RDH 20 top document tray 16. They are sequentially fed from by the tray 16 a pneumatic bottom separator/feeder 17 and counted by being fed by a conventional optical sheet edge sensor 13. They are further fed in the arcuate path 19 to meet up with or merge with the alternate SADH document entrance 22 path, which also feeds documents, to the upstream end of the platen transport belt 24 and onto the platen 30 at an infeeding position 25 there. This infeeding position 25 at which the document is initially fed onto the platen 30 and acquired in the nip therewith of the platen transport belt 24 here is substantially upstream of the upstream end 30*a* of the platen 30.

Just upstream of this document infeeding position 25 here is another conventional document edge optical sensor 29 (corresponding to reference 31 in the cited U.S. Pat. No. 4,579,444). In this particular RDH 20, an underlying pivotal infeeding area light reflective baffle 26, preferably liftable by a solenoid 28 closely overlays the platen 30 in the area thereof extending from the platen upstream edge 30*a* to the infeeding position 25. This infeeding area light baffle 26 is otherwise somewhat similar that shown and described in XDJ Vol. 7, No. 4., July/August 1982, p. 275.

The disclosed electronic document imaging system 11 may be utilized in lieu of a conventional light-lens imaging system for electronic document imaging for a subsequent or integral printer. The electronic optical scanning system 11 reads document images on the imaging platen 30. As disclosed here schematically in FIG. 1, an exemplary electronic image scanning system 11 may be provide scanning from under the platen 30 with a scanner 40 which may be mounted on and reciprocally driven by a typical horizontal optical scanning carriage. The electronic image scanning system 11 here provides for scanning up to the full length or the entire area of the platen 30, from the ends 30*a* to 30*b*, (see the movement arrows) to be able to image a document of any size which can be fitted onto the platen 30 upper surface. Conventionally, a document illuminating lamp and reflector light source may be located on the same scanning carriage.

The electronic imaging member 40 may be a conventional full width imaging bar or scan head CCD sensor array, preferably with an integral conventional lens strip such as a well known Selfoc TM multi-elementlens or fiber optics array, as in U.S. Pat. No. 3,977,777, for example. Such electronic digitizing of the document image, for integral or separate digital copying, printing, facsimile transmission, and/or other digital image processing, enhancement, and/or manipulation, is rapidly becoming more important and critical, as compared to conventional copying with conventional light lens optical input, or the like. This is sometimes called an "EFE" or "electronic front end". Above-cited examples included Xerox Corporation U.S. Pat. Nos. 4,757,348, 4,295,167 and 4,287,536. The electronic image scanning may be bidirectional, as is known for example from Eastman Kodak U.S. Pat. No. 4,150,873 issued Apr. 24, 1979, to G. Dali and Xerox Corporation U.S. Pat. No. 4,205,350. Also, various electronic buffer and page collation systems may be connected to or made a part of the EFE, as disclosed in above-cited references, IBM Corp. U.S. Pat. No. 4,099,254 or 4,213,694; Eastman Kodak Canadian 1,086,231 or UK 1 531 401; the Xerox Corporation "1200" and "9700" printers, etc.

With document handler 20, normal sized documents are fed and registered and ejected entirely unidirectionally on the platen 30, in a generally conventional manner, with the servo-driven non-slip platen transport belt 24. Thus, normal size automatically fed documents are registered in a registration position entirely under the platen transport belt 24, downstream from the baffle 26.

However, with this particular document handler 20, a large oversize document (only) is initially fed onto the platen 30 in the same manner and direction but then is automatically treated differently, in accordance with being sensed as being oversized as it is fed in. The large document feeding continues until the downstream or lead edge area of the large document is overfed past the downstream end 30*b* of the platen (so that the lead edge area of the document actually briefly enters into the document exit or post-platen ejecting area 31). At that point in time, the trail edge of the oversized document has passed the upstream document edge sensor 29 and the downstream edge 26*b* of the baffle 26 in passing through the infeeding position 25 so that the length and oversized nature of that document is known by the copier controller 100. An oversized document includes any document which, at the feed-in point, exiting the infeeding position 25, would have any portion thereof extending beyond the downstream edge 30*b* of the platen 30, and would be imaged that way if handled as a normal document. In response to that oversize information, the document platen transport is automatically reversed (but preferably operated at a much slower reverse speed than the forward speed), and the document is "backed-up" into a desired copying position registered relative to the upstream platen edge 30*a*. That reverse document movement into the large document copying position moves the trail edge area of the large document back under the infeeding baffle 26 towards the upstream edge 30*a* of the platen. The backing-up of a document, and the coordinated lifting of the baffle 26 downstream end 26*b* by solenoid 28 as described herein, is automatically actuated only for documents which are sensed as being oversized. All documents are fed in onto the platen 30 through the normal SADH or RDH input path guide baffles leading to input area 25, as shown, which baffles are above the baffle 26. The end of these document entrance baffles provides a document infeeding entrance position at the input area 25 which the trail edge of the documents must clear or exit.

In the example here, the solenoid 28 is connected to the upstream end 26*a* of the baffle 26, and horizontal movement downstream of the baffle 26 by actuation of the solenoid 28 lifts the downstream lip 26*b* of the baffle 26 away from the platen 30 and above the plane of the platen transport belt 24 lower flight. In that raised position, the baffle lip 26*b* and associated (now inclined) lower surface of this baffle 26 in effect becomes a stripping gate or deflector to ensure that the previously trailing edge of the now reversed movement large document will back up under, rather than over, the baffle 26.

When the solenoid 28 is not actuated, the baffle 26 is dropped or lowered into its normal generally horizontal position directly overlying the platen 30, by being lowered substantially into that plane. Preferably the lower surface of the baffle 26 is normally allowed to rest directly and flatly on the platen 30 upper surface by gravity when the solenoid 28 is disengaged. I.e., preferably here the input path of a large document as well as a normal document is above or over the top of the baffle 26, and with the baffle in its lowered position, as previously noted. In the case of normal sized documents, the solenoid 28 need never be actuated and the baffle 26 can stay down flat directly on top of the area of the platen it overlies at all times.

Turning now to the disclosed example of the specific system of the invention, referring to the overall sensing and control system embodiment 90, which is integral the automatic recirculating document handler 20, the system 90 includes a document presence sensor 80 and a set separator unit 50 for set separation, i.e., for detecting the end of the feeding of the document set, by signaling the feeding of the last sheet in the document set, and also for distinguishing those documents in stack 14 to be fed from those which have been returned to the document tray 16 and restacked. Both the document presence sensor 80 and the set separator unit 50 are connected to the controller 100, as will be described.

First describing the exemplary set separator unit 50, per se, here this is a prior art example from U.S. Pat. No. 4,589,645, except that here it is located in the registration side wall near the rear or restacking end of the document tray 16 of the RDH 20. It includes an integral finger, arm or bail 52 normally rests on the stack 14 lightly. The finger 52 moves down with gravity as sheets are fed out from the bottom of the stack 14, and are therefore fed out from under the finger 52. When the finger 52 is no longer over any more documents it drops through a slot in the tray 16 bottom, shown if FIG. 2, into a position to activate a photoswitch which signifies that all the document sheets in the set have been fed out of the tray 16 to be copied once, i.e. circulated once. The finger 52 is then automatically reset to an initial or reset position on top of the stack 14, to initiate another cycle, by a solenoid actuating mechanism.

The sensed position of the finger 52 on the top of the stack 14, on which the finger 52 is automatically placed before any document feeding is initiated, may also utilized to provide an indication of the stack height, for automatically adjusting vacuum, air, and/or normal force pressures in the document feeder to compensate for the height (and therefore indirectly for the weight) of the stack, as further described, for example in the cited U.S. Pat. Nos. 4,589,645 or 4,469,320.

Further describing from U.S. Pat. No. 4,589,645 the mechanical structure and operation of the document set separator/circulation counter system 50, re FIGS. 3, et al, this particular set separator unit 50 has its finger, arm or bail 52 controlled directly and solely by its eccentric pivotal connection to a single rotated arm or sector 54, with a cam 58, providing all of the required movements of retraction, lifting, re-extension and dropping of the bail or finger 52. The set separator unit 50 is positively driven by its arm 54 and its cam 58 through the reset cycle. The increased length of the separator finger 52 decreases the angle at which it rests on top of the document stack 14.

The bail arm or finger 52 is returned to the top of the document stack 14 with a minimum number of parts. The finger 52 is pivotally connected to the rotary arm or sector 54, which is rotated by a cable pulley attached to it. The arm 54 and its integral cam 58 is partially rotated, by approximately 60 degrees, by means of a solenoid 56 via this cable attached to the pulley. For the first 25 degrees or so, the finger 52 is pulled back basically horizontally. The finger 52 is moved about one-half of its total retraction before it begins any upward movement, to ensure that it is well behind the stack before it is lifted. Then in the final 35 degrees, the finger 52 is lifted up, by the cam 28. A spring action then returns the solenoid and propels the arm 52 through its return path back out over the document stack. A simple and inexpensive linear (or rotary) solenoid 56 may be used, preferably with a connecting cable, pulley, and spring 38 arrangement as shown, so that retraction of the bail 52 away from the stack is by the solenoid 56 pull-in, while return movement is by the opposing spring force rotating the arm 54 back towards the stack (in the opposite direction).

To re-express the above, the disclosed document set separator unit 50 has a finger or elongated bail 52 having one end thereof eccentrically mounted to an oscillating solenoid driven arm or disc 54. This arm 54 has a cam surface 58 oscillating therewith which operates intermittently on an intermediate portion of the finger 52. This combination drive provides, first, a quasi-linear retraction of the previously dropped separator finger or bail 52 away from under the end of the stack 14, then its arcuate elevation, once free of the end of the stack, and then its quasi-linear return (preferably with the aid of an elevation retaining cam surface or magnet) back out over the top of the stack, extending the finger 52 out over (above) the stack without contacting it, and then dropping it down onto the top of the stack, well away from the edge, unconstrained, so that it drops onto the upper surface level of that particular stack. About one-half of the total travel of the bail 52 is basically horizontal only. This travel is provided for the bail 52 in its initial retraction movement away from the end of the stack. This insures that the end of the finger 52 is pulled all the way out from under the end of the stack 14 before any lifting of the finger 52 is initiated.

Note that the unique shape of the central portion of the arm or bail 52 itself controls the blocking and unblocking of two commercial photo-optical pair sensors 31 and 32. These are an upper, stack height, sensor 31, and a lower, set separator, sensor 32. Here, as will be described, these sensors are directly tripped by the bail arm 52 itself, for more precise document stack height sensing. Specifically, there is provided a preformed notch 34 on one side of th finger 52 and a projecting tab 36 on the opposite side. It will be appreciated that other suitable configurations may be provided. There is a preset vertical distance (arm 52 width) therebetween relative to the vertical distance between the two sensors 31 and 32, and a preset horizontal extent of both the notch 34 and tab 36. The horizontal extent thereof controls the blocking or unblocking of the sensors during the reset operation, when the arm is being fully retracted, as will be explained. The tab 36 and notch 34 enable the two sensors to be further apart and less critical as to arm movement position, i.e. provide a more accurate stack height indication less affected by the sensor mounting positions, for more accurate input to their connecting input to the conventional microprocessor controller 100, which in turn controls the stack feeder 17, particularly the air level control thereof, as described in the above-referenced patents.

The two spaced sensors or switch means 31 and 32 are positioned to be variably actuated by the notch 34 and tab 36 in response to variable positions of the set separator finger 52 for actuating one, none, or both of said sensors 31 and/or 32 at respective vertical (and horizontal) positions thereof. In response thereto, the controller 100 provides six different automatic control outputs in response to four different combinations of sensed actuations or non-actuations of said two spaced sensors 31 and 32 and the operating times at which said combinations of actuations or non-actuations are sensed. These six different automatic controls in response to four different combinations of sensor actuations or non-actuations provide respective signals responsive to a stack which is too high for reliable feeding, a stack which is high, a medium height stack, a low stack, no stack, or the end of a circulation of the stack.

In response to one of said four combinations of actuations or nonactuations of said switch means 31 and 32 the solenoid 56 is actuated by controller 100 to withdraw the set separator finger 52 from the stack 14 and reset it on top of the stack, as described. In the end-of-set (or no document present) position of FIGS. 3 and 4, it may be seen that both sensors 31 and 32 are uncovered or unoccluded. That is, the opposing light source for each sensor reaches each sensor without blockage by any portion of the set separator finger 52 being therebetween. This starts or initiates the resetting cycle shown in the respective Figures. Retraction movement is started as shown by the movement arrows in FIG. 4.

Figure 4:
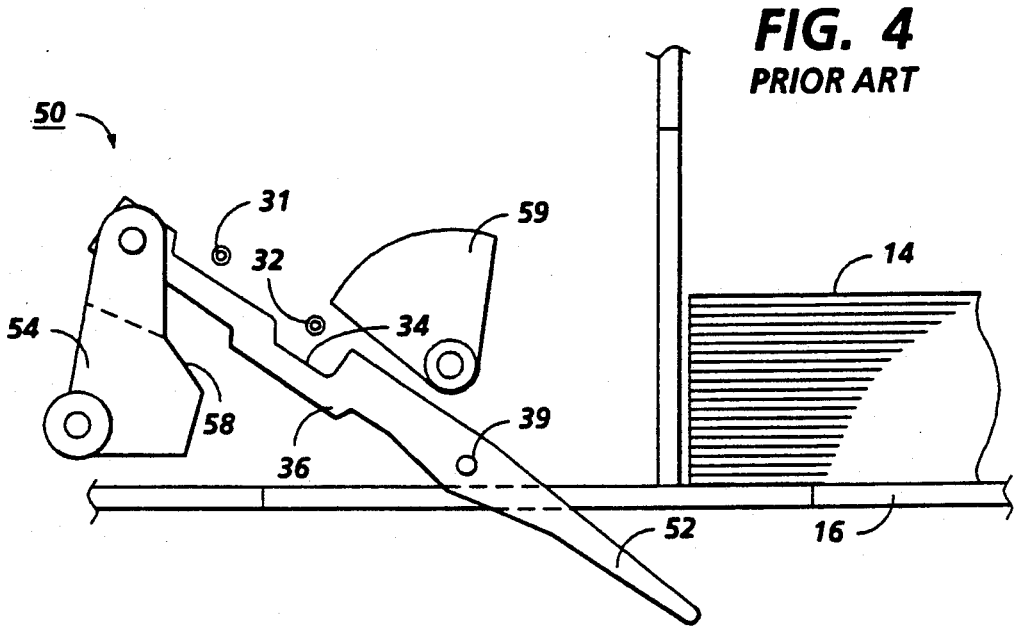
FIG. 4 PRIOR ART
Figure 5:
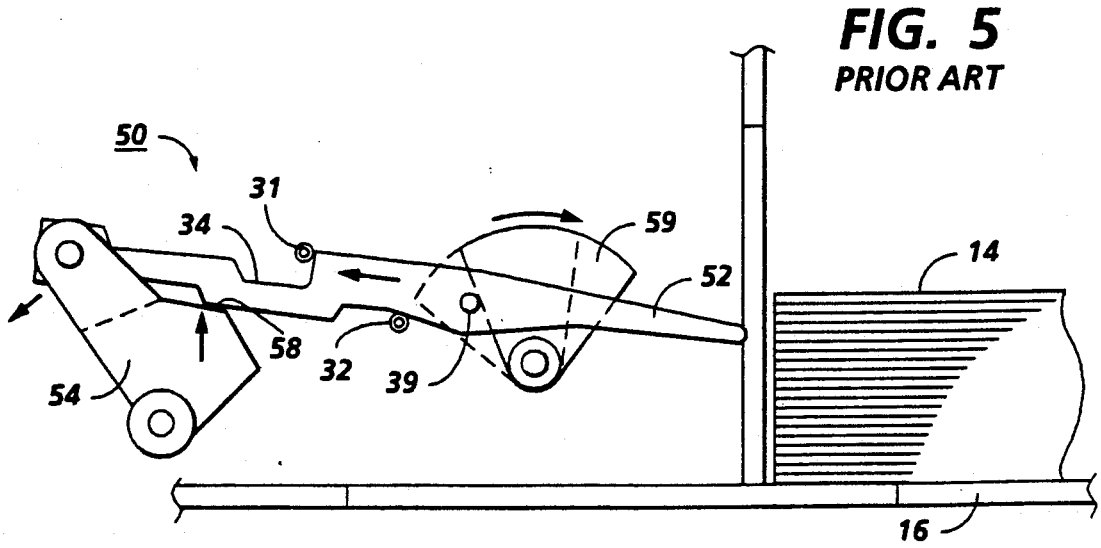
FIG. 5 PRIOR ART
Figure 6:
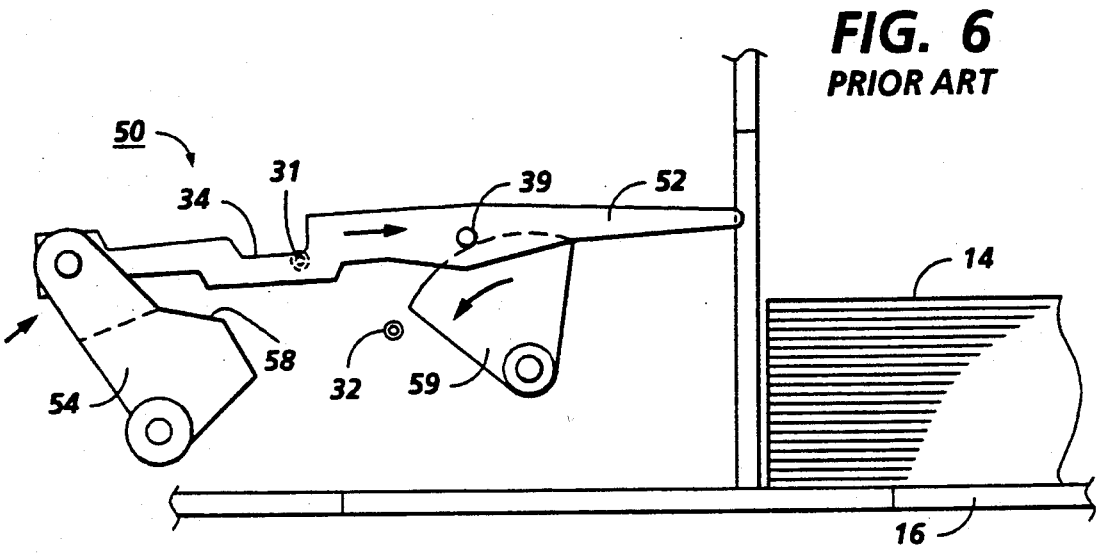
FIG. 6 PRIOR ART
Figure 7:
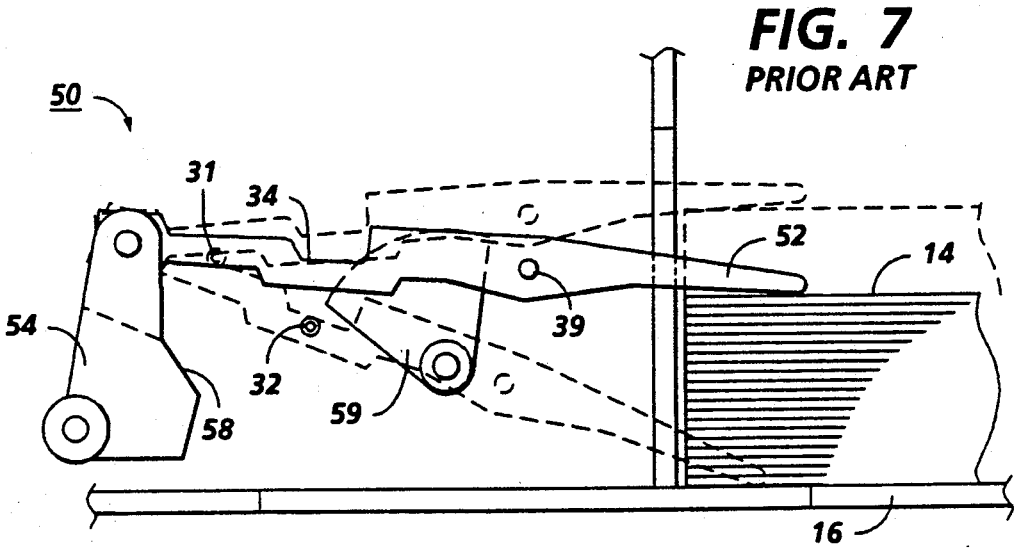
FIG. 7 PRIOR ART

Referring now particularly to the various illustrated operating positions of the set separator system 50 variously illustrated in FIGS. 3–7, FIGS. 3 and 4 show the system after the finger 52 has dropped through the slot in tray 16 as described above, and just as it is about to be reset. FIG. 5 shows the system near the end of the finger 52 retraction step of the resetting operation, as the cam 58 is lifting the finger 52 vertically. FIG. 6 illustrates the return movement of this resetting operation. FIG. 7 illustrates the finger 52 in its returned (reset) stack height sensing position, for three different stack heights.

At the end of the pull-in stroke of solenoid 56, a pin 39 on finger 52 is lifted up above the rear lip of an additional (optional) return cam 59. The cam 59 is pivotally spring-loaded to positively snap back under the pin 39 at that point (see the dashed-line position of cam 59 in FIG. 5 vs the solid line position thereof). Thus when current is removed from solenoid 56, spring 38 rotates arm 54 forward, as shown in FIG. 6, and pin 39 rides up over the top of cam 59 to hold finger 52 up above the highest possible stack 14, and the finger 52 is advanced out over and above stack 14. When pin 39 reaches the end of the cam 59 cam surface the finger 52 is then free to drop down vertically onto the top of the stack, down to whatever the height of that stack may be, and at a position well beyond the stack edge, so as not to read or be affected by any edge curls in the documents at the edge of the stack.

Even in the above-described resetting operation, the sensors 31 and 32 serve a function. The controller 100 logic "looks" at the inputs from these sensors, at the time it is providing the actuating signal to the solenoid 56, to check for occlusion of the upper sensor 31 and not the lower sensor 32, as shown in FIG. 4. When that combination of 3 signals occurs, the controller 18 knows that the finger 52 has been lifted up or "cocked" by cam 58 and is in the correct position for release of solenoid power for the return or resetting movement of finger 52. Note that this is accomplished by terminating the notch 34 in finger 52 at a position relative to the "cocked" position of finger 52 such that an unnotched portion of finger 52 will block sensor 31. Note also that sensor 31 is positioned horizontally rearwardly of sensor 32, as well as vertically spaced thereabove. The combination of a solenoid operating signal and blockage of only sensor 31 signals the release of finger 52 to immediately fly forward and then immediately drop to detect stack height, if any.

As the outer or height-sensing end of the finger 52 drops onto the stack, the inner portion thereof including tab 36 correspondingly drops sequentially past the sensors 31 and 32 to provide stack height sensing information.

Assume first an "overstack" condition, as shown by the uppermost dashed-line positions of stack 14 and finger 52 in FIG. 7. In that condition (too many documents for reliable document feeding) neither sensor 31 nor sensor 32 will be occluded. The finger 52 dropping motion is stopped before it drops far enough for finger 52 to even cover upper sensor 31. Note that in this position the tab 36 is now forward of sensor 31 and cannot intercept sensor 31.

A stack 14 level which is high, but not overstacked, is exemplified by the solid line position in FIG. 7. There is a preset range of such "high" stack levels, which is sensed by occlusion of only sensor 31 but not sensor 32, as shown. This provides a "heavy" stack signal output from controller 100, which can provide a higher level air-knife level control. This "high" (but not "overstack") range may be, for example, for stack heights of, for example, from 25 mm. to 6.5 mm.

If the stack 14 height is in a "medium" range, the system is designed so that both sensors 31 and 32 are occluded in this range. In this "medium" stack range, tab 36 covers sensor 32, yet sensor 31 also remains covered by the rear of finger 52. This "medium" stack height range extends over a range of finger 52 initial reset positions from the above-described "high" range up to a "low" stack position. This "medium" stack height range may be, e.g., for stack heights of from 6.5 mm. to 1.5 mm., and can be used to set a corresponding medium level air control.

"Low" stack heights are illustrated by the lower dashed line position of finger 52 and stack 14 in FIG. 7. For "low" stacks only the lower sensor 32 is occluded, and the upper sensor 31 is now uncovered. This 32 but not 31 signal combination tells the controller 100 that some, but only a small number, of sheets are in tray 16. The air knife pressure level may be reduced accordingly to avoid over-fluffing the small stack. Thus, the set separator system 50 here can automatically provide a variable pneumatic setting for sheet feeding, including an accurate air knife level for the particular thickness of the sheet stack being fed, thereby minimizing misfeeds or jams.

If the finger 52 drops all the way down immediately after the resetting operation, uncovering both sensors, then the controller 100 knows that there is no stack present, i.e. no documents have been loaded, or they have all been removed from the tray. In contrast, if this drop signal occurs after a time delay after a normal reset to one of the stack height positions, it provides an end of set circulation signal.

Turning now to the system 90 herein, the information signals from the document sheet set separator 50, or other set separator, may be combined with the document sheet presence sensor 80 in the controller 100. There is provided a control algorithm which permits the long-lived document-present-sensor 80 to substitute for the shorter-lived set separator mechanism 50 in maintaining set integrity for many casual walk-up jobs comprising job or document set with a small number of documents. The implementation requires only simple software and is therefore inexpensive.

This system 90 effectively utilizes, but improves upon, the conventional existing dropping arm switch set separators such as 50, which signal the end of each circulation of a document set from the RDH tray. As described, in such a system 50 for each document set feedout the arm 52 is first set on top of the stack 14 of documents in the RDH tray 17 and then drops whenever the last sheet is fed out from under the arm to actuate a switch means. (which also signals for the arm to be automatically reset on top of the stack again.) That system 50 is still automatically normally utilized here for document sets of more than four documents loaded into the tray 16.

However, in this improved system 90 it has been discovered that for a one, two or three sheet document set job or stack 14, where all 1–3 of the documents have been fed out of the RDH tray 16 into the RDH document circulation loop path from and to the tray 16, that before any have been returned and restacked therein, that there is a brief time interval in which the existing optical document presence sensor 80 in the tray bottom (optically looking across one side edge corner) is exposed (unblocked), since no documents are in the tray 16 at that point in the circulation of such a small job. The connecting controller 100 is so signaled for that brief time period, which is only one or two seconds or less. But once the first-fed document sheet restacks back in the tray 16 bottom, the "document presence" sensor 80 is blocked again, and so signals that to the controller 100, until the end of the next completed small set feed-out, etc., etc.. [In contrast, if the documents had been otherwise all removed from the tray 16, the document presence sensor 80 would have remained unblocked, and so signaled indefinitely].

Accordingly, it has been discovered that the controller 100, which of course has internal timing comparison available, can be simply and readily programmed to look for and respond to a said brief, limited preset (e.g., not longer than two seconds) time period "no document preset" signal coming from the connecting optical electronic document presence sensor 80, and that recognized signal can be used to signal the feeding out of the complete document set, for the first and every other subsequent set circulation, rather than, or in addition to, the set separator 50 arm 52 dropping switches. In response to that recognized signal the "set separator" arm 52 may be automatically effectively disabled or rested for the rest of that job. I.e., the solenoid 56 is not reactuated, and the arm 52 is left dropped down and not reset after the first circulation or set feed-out, and likewise the sensors 31 and 32 are not interrogated for the rest of that copying run for that job, irrespective of the number of set circulations. I.e., for all subsequent document set recirculations after the first.

Preferably the arm 52 flip-up or reset is used for (only) the first circulation, in all cases, to confirm document presence and initial sheet feeding and/or to provide stack height information, as described above. When the documents are first loaded into the tray 16, the actual number of documents is normally not known by the controller 100, unless that number was manually entered into an associated keypad or keyboard by the operator. If the set separator 50 has a stack height measurement system, it can signal that it is a "small" stack job which can be used to confirm that it *might* be able to use the system 90, but that cannot be confirmed until the first properly brief "no document preset" signal and/or the actual document set count is obtained by the document count 13 total when the arm 52 drops, which is first received in the first document circulation.

Depending on the overall RDH document circulation path length, this system 90 may also work for a four sheet document set as well as a 1 to 3 sheet document set. These small document sets are all very common size "jobs", normally involving rapid and frequent operation of the set separator 50, and thus high wear and increased risk of jams and machine shutdowns.

To summarize, in the sheet stacking and sequential feeding and restacking system here, in which normally an electromechanical sheet separator system in a sheet stacking tray provides an end of set detection control signal by being mechanically operated each time the last sheet of the stack is fed, the end of set detection control signal is provided by automatically switching from the normal sheet separator system end of set detector to a function of a nonmechanical, optical, presence of sheet detector for documents sets having a sufficiently small number of document sheets that all of the document sheets are in the document recirculation path after the last sheet of the set is fed out of the document tray so that briefly the optical presence of sheet detector signals that no document sheet is present in the tray.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In a method of document sheet feeding control in which a set of plural document sheets are stacked in a sheet stacking and feeding tray and sequentially fed out from said tray for processing and then returned through a plural sheet length sheet circulation path to be restacked in said same tray, and then recirculated again through said sheet circulation path for reprocessing and restacked in said same tray again; in which the presence or absence of any sheets in said tray can be detected by an nonmechanical optical sheet presence detector signal automatically provided by the presence of any sheets in said tray occluding said optical sheet presence detector, and in which each circulation from said tray of said set of sheets is normally signaled by an electromechanical sheet separator arm system which normally mechanically drops each time the last sheet of said set of sheets is fed out from said tray to provide an end of set detection control signal for each circulation of said document set, and which electromechanical sheet separator arm system is then normally automatically reset on top of said set of sheets in said tray for each circulation of said document set; the improvement comprising the steps of:

normally loading a set of document sheets into said tray to normally actuate said optical sheet presence detector to provide said signal indicating the presence of document sheets in said tray, sequentially feeding and circulating said set of document sheets while interrogating said optical sheet presence detector, and if said optical sheet presence detector signals that no sheet is present in said tray for even a brief time period during said circulation of said set of document sheets, then concluding that said set of document sheets has a sufficiently small number of sheets, less than five sheets, such that all of said sheets of said small set are in said plural sheet length sheet circulation path, and in response to said optical sheet presence detector signal that no sheet is present in said tray during said circulation, automatically disabling subsequent operation of said electromechanical sheet separator system and providing said end of set detection control signal by said signal from said optical sheet presence detector rather than from said electromechanical sheet separator system.

2. The method of document sheet feeding control of claim 1, wherein said automatically disabling of said operation of said electromechanical sheet separator system occurs only for circulated sets of document sheets having only one to three sheets.

3. The method of document sheet feeding control of claim 1, wherein for a set of four or less document sheets said electromechanical sheet separator system is only mechanically operated once, after said set of sheets is stacked in said tray, for only the initial feeding of said set of sheets from said tray.

4. The method of document sheet feeding control of claim 3, wherein said set of document sheets are a set of original documents being plurally recirculated in said sheet circulation path to and from a document imaging station.

5. The method of document sheet feeding control of claim 3, wherein said end of set detection control signal is automatically provided by a said signal from said optical sheet presence detector of less than two seconds in time duration.

6. The method of document sheet feeding control of claim 1, wherein said set of document sheets are a set of original documents being plurally recirculated in said sheet circulation path to and from a document imaging station.

* * * * *